US006557183B1

(12) United States Patent
Truong et al.

(10) Patent No.: US 6,557,183 B1
(45) Date of Patent: May 6, 2003

(54) MEN'S UNDERWEAR WITH DOUBLE FLY CONSTRUCTION

(75) Inventors: Tony N. Truong, Winston-Salem, NC (US); Teresa Thompson, Winston-Salem, NC (US)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 10/008,038

(22) Filed: Nov. 5, 2001

(51) Int. Cl.[7] ..... A41B 9/02
(52) U.S. Cl. ..... 2/403; 2/405
(58) Field of Search ..... 2/70, 71, 72, 73, 2/78.1–78.2, 78.3, 400, 402, 403, 404, 405, 227, 228, 238, 234; 604/385.1–396; D2/700, 712, 713

(56) References Cited

U.S. PATENT DOCUMENTS

| | | | | | |
|---|---|---|---|---|---|
| 2,113,732 | A | | 4/1938 | Koppel | |
| 2,176,790 | A | | 10/1939 | Coppel et al. | |
| 2,232,950 | A | | 2/1941 | Kneibler | |
| 2,235,848 | A | | 3/1941 | Reis | |
| 2,235,849 | A | | 3/1941 | Reis | |
| 2,243,643 | A | * | 5/1941 | Murphy | 2/403 |
| 2,258,411 | A | | 10/1941 | Flagg | |
| 2,292,227 | A | * | 8/1942 | Kopyto | 2/67 |
| 2,369,773 | A | | 2/1945 | Brenner | |
| 2,416,108 | A | * | 2/1947 | Lloyd | 2/403 |
| 2,438,310 | A | * | 3/1948 | Ashe et al. | 2/403 |
| 2,570,498 | A | | 10/1951 | Senderowitz | |
| 2,602,928 | A | | 7/1952 | Chatfield | |
| 3,029,814 | A | * | 4/1962 | Kravitz | 2/403 |
| 3,120,004 | A | | 2/1964 | McGehee | |
| 3,654,634 | A | * | 4/1972 | Torres | 2/403 |
| 4,326,302 | A | | 4/1982 | Lowe et al. | 2/405 |
| 4,345,337 | A | | 8/1982 | Chung | 2/405 |
| 4,554,685 | A | | 11/1985 | Ray | 2/403 |
| 4,807,304 | A | | 2/1989 | McCants-Reed | 2/405 |
| 5,008,962 | A | | 4/1991 | Smith et al. | 2/234 |
| 5,461,729 | A | | 10/1995 | Brocks | 2/403 |
| 5,499,404 | A | | 3/1996 | Marchiorello | 2/403 |
| 5,535,452 | A | * | 7/1996 | Rozenblatt | 2/403 |
| 6,018,822 | A | | 2/2000 | Hernandez | 2/405 |
| 6,023,789 | A | | 2/2000 | Wilson et al. | 2/228 |

* cited by examiner

*Primary Examiner*—Gloria M. Hale
(74) *Attorney, Agent, or Firm*—Womble Carlyle Sandridge & Rice, PLLC

(57) ABSTRACT

An underwear construction having a trunk panel, an inner panel with an open edge for providing access through the inner panel, an outer panel having openings along opposed side edges, the outer panel overlying the inner panel, wherein the trunk panel, inner panel, and outer panel are joined to provide a wearer of said underwear selective unencumbered access to the penis through either of the openings in said outer panel and through the open edge of said inner panel.

15 Claims, 5 Drawing Sheets

MEN'S UNDERWEAR WITH DOUBLE FLY CONSTRUCTION

FIELD OF THE INVENTION

The present invention relates generally to male undergarments, and, more particularly, to an undergarment brief or shorts having a double fly construction.

BACKGROUND OF THE INVENTION

Various forms of male undergarments have been developed over the ages. In particular, in more modern times, two types have become most widely known: underwear briefs, sometimes referred to as "jockey shorts," and a loosely fitting shorts known as "boxers."

Men's briefs are generally constructed with one or more trunk panels, and overlapping front panels. The overlapping front panels typically define a singular fly opening for access through the outermost panel to the penis for purposes of urination. Many attempts have been made to solve the numerous problems associated with the known brief constructions, such as discomfort, lack of support, and embarrassment due to unsightly bulging or slippage of the male genital organs. As a result, pouches and sacks, cages, and girdles have be incorporated into briefs toward the end of an optimal undergarment construction. Male undergarment construction has also focused on snug-fit and fly arrangements that prevent the male genitalia from falling therethrough.

The briefs known in the art have commonly been constructed with a single, right-handed fly, the fly being formed by the front panel or panels. Where inner and outer panels are used, each panel has a concave portion formed therealong one side edge, and the two panels are placed one upon the other so that the concave portion on the outer front panel is on the opposite side from the concave portion of the inner front panel. This particular construction has created a tortuous path for gaining access to the penis. Single fly constructions provide relatively convenient access for right-handed persons. Some persons, particularly left-handed persons and/or handicapped persons, require or prefer a left-handed fly. One prior art attempt at solving this problem was implemented in connection with a boxer shorts construction with a centrally-located, vertical, single front fly. A wide vent backing panel on the inside of the shorts is attached at the top and bottom and unattached on both sides. For the wearer, once the vertical front fly has been entered, either a left or right inner opening is available. While such a construction is plausible with loosely fitting boxer shorts, it would not be practical with a man's brief due to its closely/snugly fitting construction.

SUMMARY OF THE INVENTION

The present invention is directed to a man's underwear construction that addresses the problems associated with the prior art. As used herein, the term "underwear" is intended to encompass shorts, drawers, skivvies, jockey shorts, boxer shorts, briefs, long underwear, and variations thereof. In a first preferred embodiment of the present invention, the underwear construction includes a trunk panel, and inner and outer panels that are joined together along a plurality of edges, or seams, resulting in a double fly.

The panels forming the underwear of the present invention are desirably of knitted fabric, however the invention is not limited to fabric of a knitted construction. Nevertheless, the knitted fabric of the preferred embodiment is formed from yarns of 100% or less cotton; the fabric also could well be knitted or woven from blended natural and synthetic yarns.

In the first embodiment, the trunk panel is the largest single panel forming the underwear and has an upper edge, lower edge, and opposed side edges. The opposed side edges have concave cutouts formed therealong that terminate at the bottom edge. The concave portions, when attached to front panels, define leg openings.

The present invention uses two uniquely formed front panels. The inner panel has top and bottom edges and opposed side edges, where the bottom edge is joined to the lower edge of the trunk panel and the opposed side edges are joined along their uppermost portions to the opposed side edges of the trunk panel. The top edge of the inner panel does not extend to the top of the outer panel and is unattached so that an opening is formed between the inner and outer panels. The outer front panel overlies the inner front panel and is joined to the lower edge of the trunk panel and to the upper portions of the opposed side edges of the trunk panel. Each of the opposed side edges of the outer front panel are unjoined along at least some portion to form a fly on each of the opposed side edges. A wearer of the underwear so formed can access either fly.

These and other aspects of the present invention will become apparent to those skilled in the art after a reading of the following description of the preferred embodiment when considered with the drawings.

DESCRIPTION OF THE PREFERRED EMBODIMENTS

Figure 1:
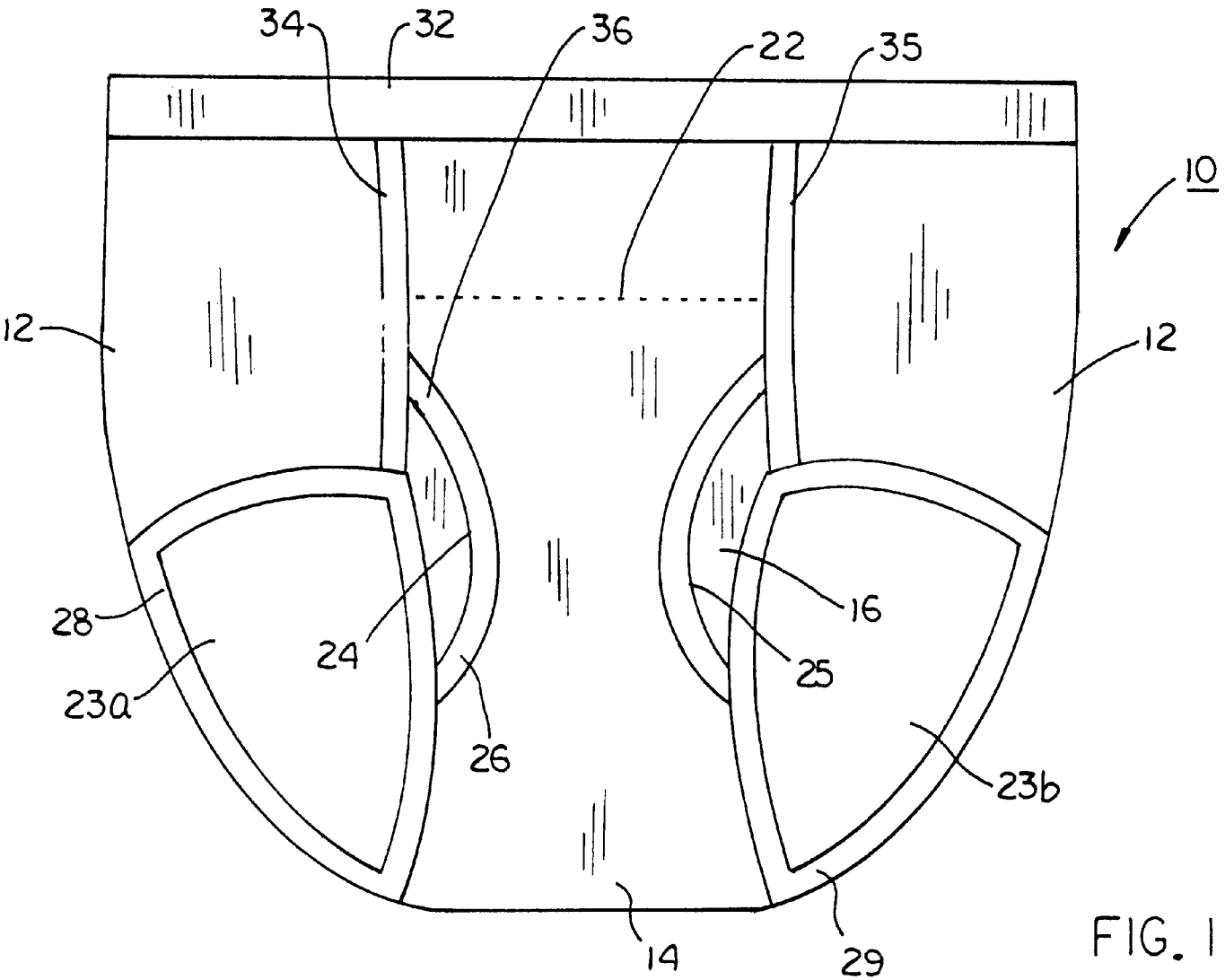
FIG. 1 is a front view of the men's underwear brief of the present invention.
Figure 2:
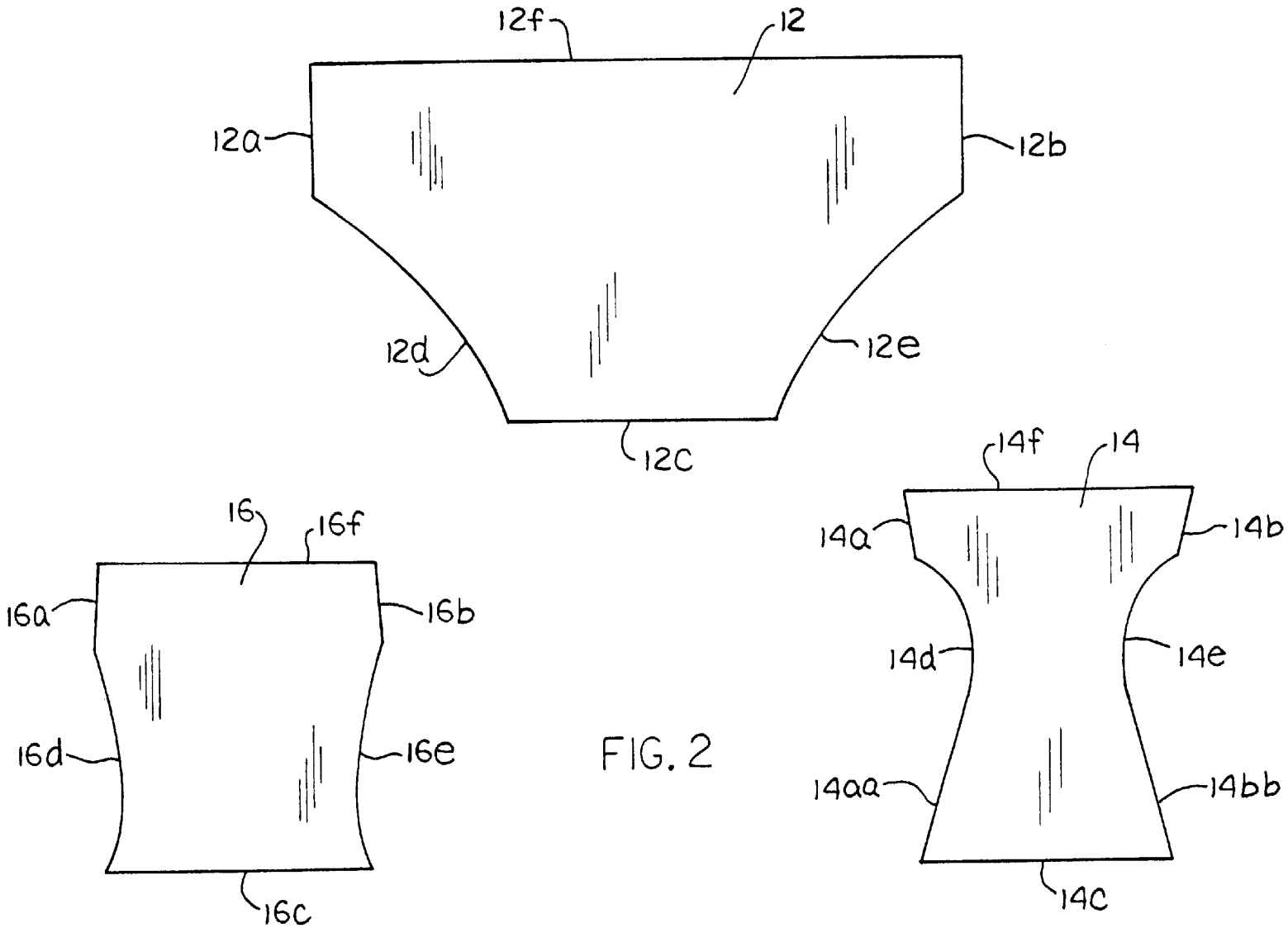
FIG. 2 is an plan view illustrating the panels that form the brief of FIG. 1.

Referring now to FIGS. 1 and 2, it will be understood that the illustrations are for the purpose of describing a preferred embodiment of the invention and are not intended to limit the invention thereto. FIG. 1 is a front schematic view of a pair of men's underwear briefs according to the present invention, shown generally as 10. In one embodiment, the briefs are shaped in conventional fashion for "jockey" type briefs, although the invention is not limited to a brief construction. As best illustrated in FIG. 2, in the preferred embodiment, the briefs 10 are formed from three panels that are joined together along specified seams. The panels are each formed from a single knitted fabric of yarns that are 100 percent cotton; however, the fabric forming the panels are not limited to a 100 percent cotton structure, and are not limited to knitted fabric.

FIG. 2 best illustrates the shapes of the three panels used to form the briefs before they are joined together. As those skilled in the art will appreciate, the sequence of joining the panels is not critical and the description which follows regarding joinder along seams should not be construed as a required sequence. Likewise, the number of panels is not critical so long as the front panel includes two flies. Generally, the panels are aligned and a binding is sewn over the panel junctures to securely join the edges of the panels together and to create an aesthetically acceptable appearance and comfortable feel. As used herein, the term "binding" refers to a strip of like material that is placed over the juncture of adjoining panels or along the exposed unfinished edges of a panel.

Referring now to FIG. 2, the construction of the briefs 10 will be described in detail. Trunk panel 12 covers the trunk, or buttocks, of the wearer of the brief and extends around the waist to the front of the briefs. Trunk panel 12, inner panel 16, and outer panel 14 are sewn together along their bottom edges 12*c*, 14*c*, and 16*c* to form a lower seam. Trunk panel 12 wraps around the front of the briefs for attachment to inner panel 16. Specifically, edges 12*a* and 12*d* of trunk panel 12 are attached to edges 16*a* and 16*d*, respectively, of inner panel 16. Similarly, edges 12*b* and 12*e* of trunk panel 12 are attached to edges 16*b* and 16*e*, respectively, of inner panel 16. As will be understood, the attachment of edges 12*d* to 16*d* and 12*e* to 16*e* also create leg openings 23*a*, 23*b* for the briefs as shown in FIG. 1.

Figure 3:
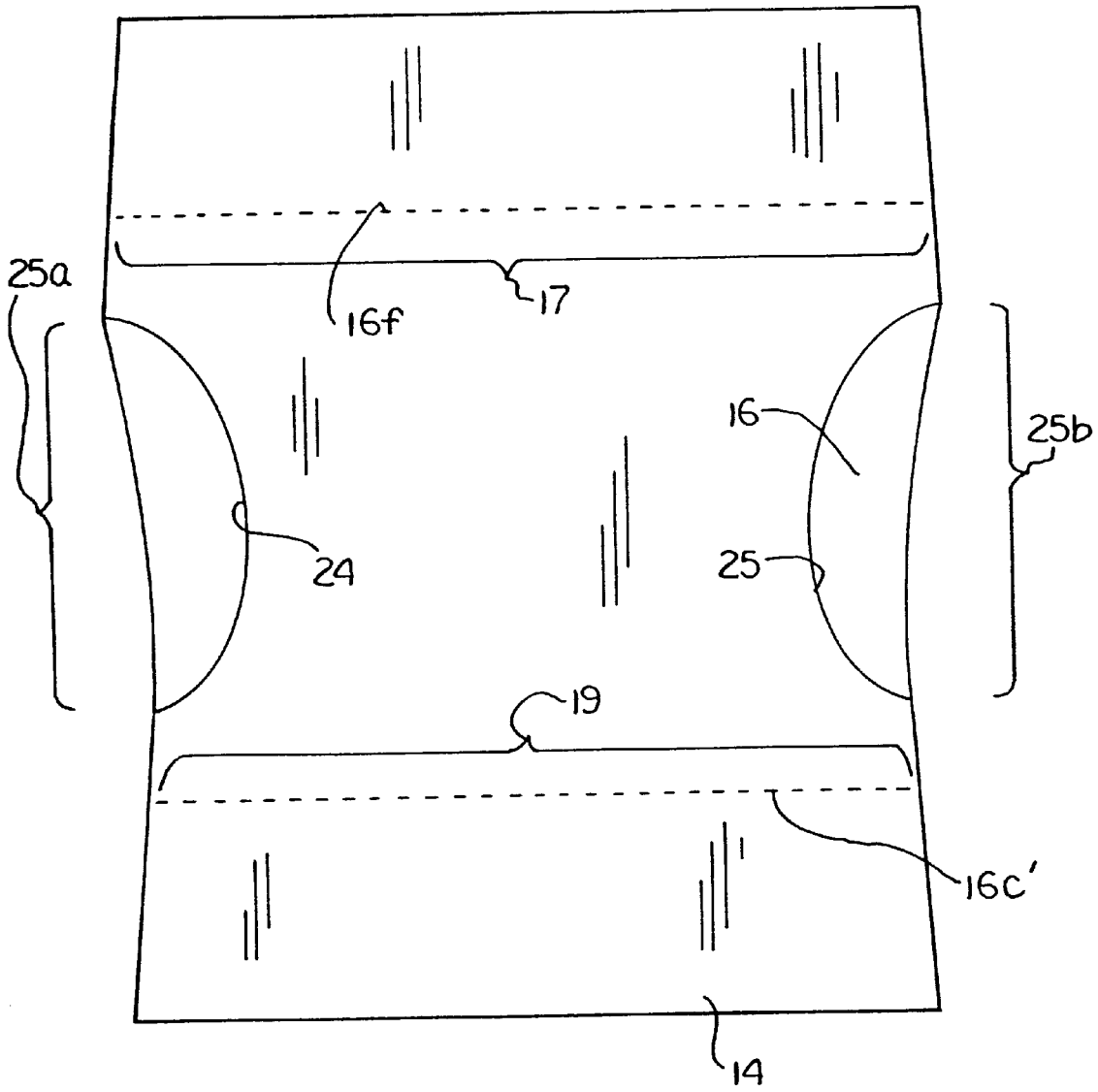
FIG. 3 is a front view of the inner and outer panel construction of the present invention.

Returning to FIG. 2, trunk panel 12 is joined to outer panel 14 so that outer panel 14 overlies inner panel 16. The overlying front panel construction is best seen in FIG. 3. Returning to FIG. 2, inner panel 16 is attached along its lower edge 16*c* to the bottom edge 12*c* of trunk panel 12, as described above. Likewise, outer panel 14 is attached along its lower edge 14*c* to bottom edge 12*c* of trunk panel 12. Alternatively, edge 16*c* of inner panel 16 may not extend completely down to to edge 12*c* and may be left unjoined so that a lower opening between outer panel 14 and inner panel 16 is formed therebetween. Edges 14*a* and 14*b* of outer panel 14 are attached to edges 16*a* and 16*b*, respectively, of inner panel 16, and outer edges 14*aa* and 14*bb* of outer panel 14 are attached to the lower portions of edges 16*d* and 16*e*, respectively, of inner panel 16, so that the outer panel 14 and inner panel 16 are securely overlapping.

As can be seen in FIGS. 1 and 3, outer panel 14 has cutout portions 24 and 25, which when the outer and inner panels are securely overlapped, form opposing flies on either side of outer panel 14 for openings between the outer and inner panels. Preferably, inner panel 16 is shorter than outer panel 14, so that, when overlapping, upper edge 16*f* does not extend to the top of the briefs as does edge 14*f* of outer panel 14, and is not joined to outer panel 14. This creates an opening 22 between the outer and inner panels for upper access to the penis. While edges 16*f* and 16*c*' are shown as horizontally configured openings between the inner and outer panels, they are not limited thereto. Similarly, the opposing flies 25*a*, 25*b* may be positioned higher or lower on the briefs and do not necessarily have to be aligned at the same height on the front panels.

Returning to FIG. 1, a waistband 32 of elastic fabric is sewn around the upper periphery of the briefs to aid in holding the briefs in proper alignment about the torso. Additionally, bindings 34 and 35, and 28 and 29, are secured over the seams between the trunk panel 12 and the inner and outer panels 14, 16, as well as around the leg openings.

Figure 4:
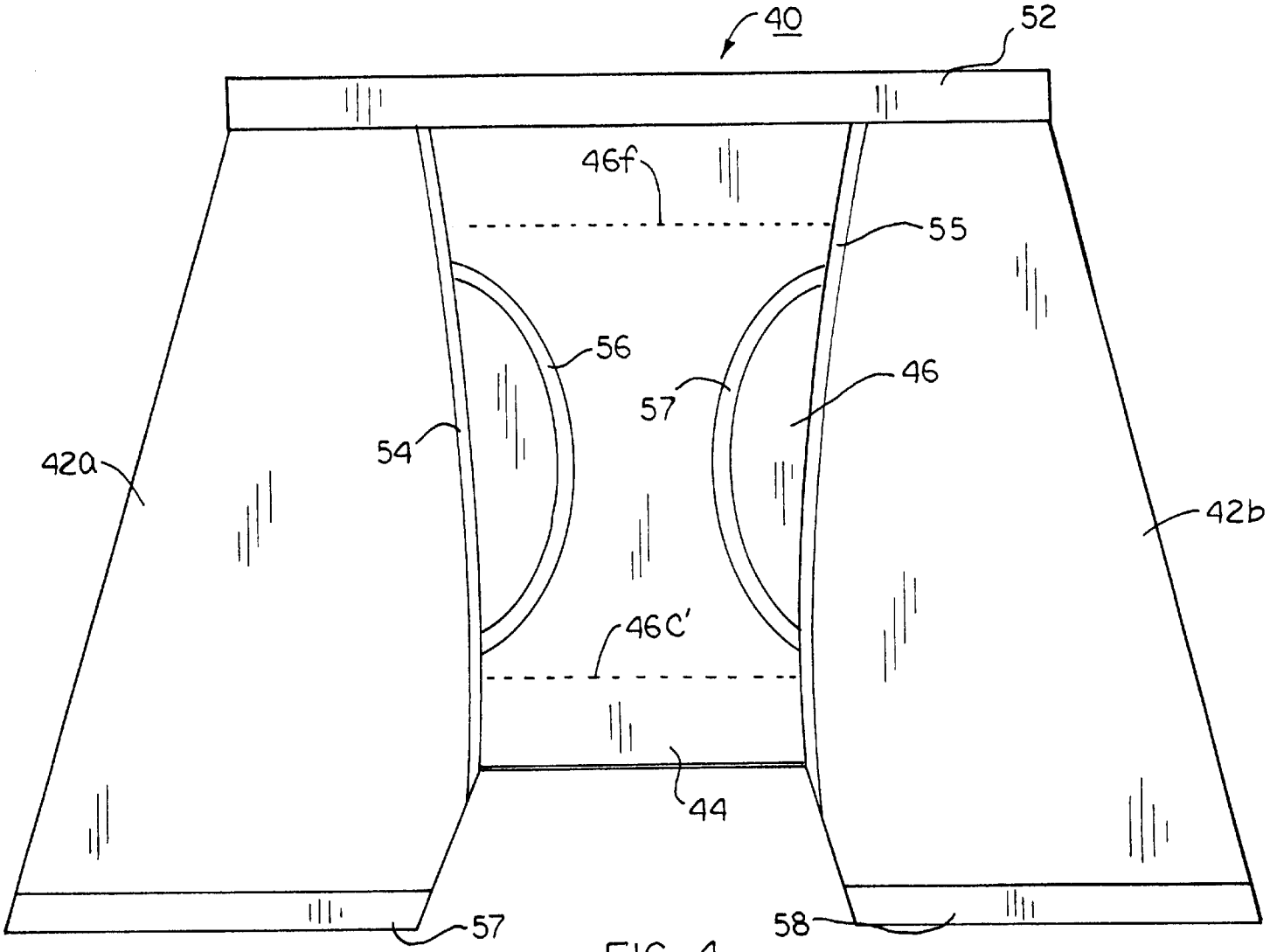
FIG. 4 is a front view of the men's boxer shorts of the present invention.

A second embodiment of the present invention provides a men's underwear formed as boxer shorts, shown generally as 40 in FIG. 4, also with a double fly. The overlying arrangement of the inner panel 46 and the outer panel 44 is the same as that of the briefs 10, with opposed flies and at least one opening formed by the unattached upper 46*f* or lower edges 46*c*' of inner panel 46. The principal differences between the construction of the briefs and the construction of the boxer shorts are the number and shape of panels and the joinder or attachment thereof.

Figure 5:
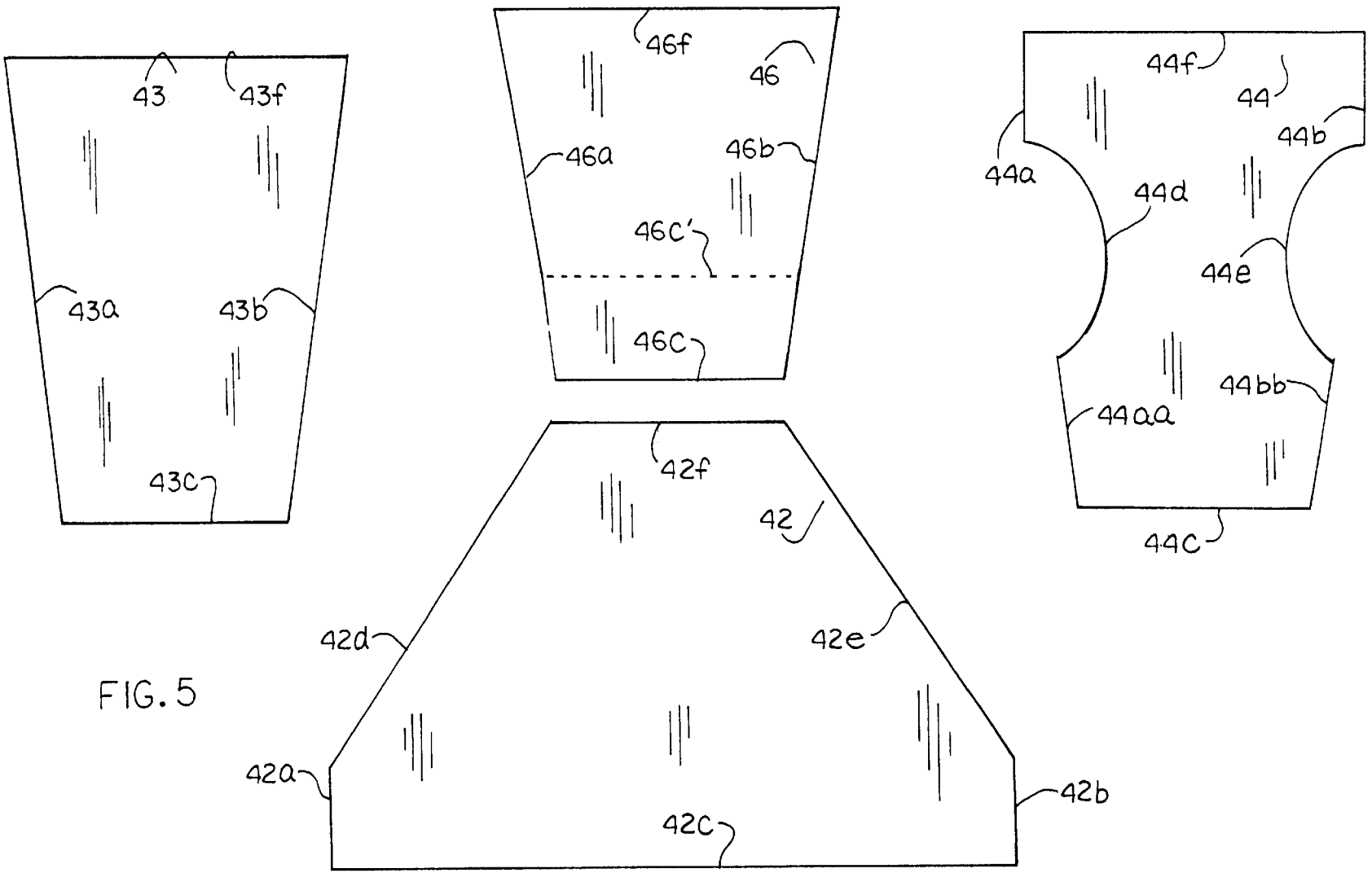
FIG. 5 is an plan view illustrating the panels that form the boxer shorts of FIG. 4.

Referring to FIGS. 4 and 5, it can be seen that the boxer shorts 40 are formed from five panels, consisting of four different shapes. There are two leg panels 42 that are identically formed to form the left and right leg portions of the boxer shorts 40. A can be seen in FIG. 5, and as will be readily understood by those skilled in the art, the trunk portion of the boxer shorts 40 is formed by a rear panel 43 that is joined along edge 43*a* to an edge 42*d* of one leg portion and along edge 43*b* to an edge 42*e* on the opposed leg portion. Edges 42*a* and 42*b* on each leg portion 42 are joined together to complete the leg construction.

Bottom edges 46*c* of inner panel 46, bottom edge 44*c* of outer panel 44, and edge 43*c* of the rear panel 43 are joined together to form the bottom seam of the boxer shorts seat portion. Edge 46*a* of inner panel 46 is joined to edge 42*d* on one leg portion and edge 46*b* of inner panel 46 is joined to edge 42*e* on the opposed leg portion. Similarly, edges 44*a* and 44*aa* of the outer panel 44 are attached along the upper and lower portions of edge 42*d* on one leg portion and edges 44*b* and 44*bb* are joined along the upper and lower portions of edge 42*e* on the opposed leg portion.

Cutouts 44*d* and 44*e* are unjoined so as to form opposed fly openings between the outer panel 44 and inner panel 46. Similar to the first embodiment, edge 46*f* of inner panel 46 is unjoined, creating and inner opening between inner panel 46 and outer panel 44. As in the first embodiment, the bottom edge of inner panel 46 need not extend downward for joinder at the bottom seam. A shorter inner panel may terminate at a lower edge 46*c*' to create a second inner opening between inner panel 46 and outer panel 44.

Referring again to FIG. 4, bindings 57 and 58 may be applied along edges 42*c* (FIG. 5) of each leg opening bottom. Similarly, bindings 54, 55, 56 and 57 may be attached along fly openings edges 44*d* and 44*e* and the seams between the edges joining the inner, outer, leg, and rear portions of briefs 40. An elastic waistband 52 is desirably also attached around the upper periphery of the boxer shorts.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. An underwear construction comprising a trunk panel, an inner panel having a top and a bottom, and an outer panel wherein the inner panel, outer panel, and trunk panel are attached in such a way that the underwear construction has an outside, an inside, and an upper periphery, and so that at least one opening is created on the inside between the inner panel and outer panel, and wherein the inner panel, outer panel, and trunk panel are attached in such a way that there are two openings on the outside between the inner and outer panels, to provide a wearer of said underwear selective unencumbered access to the penis through either of the two outer openings and through the inner opening.

2. The underwear construction of claim 1 wherein the at least one inner opening is formed at the top of the inner panel.

3. The underwear construction of claim 1 wherein the at least one inner opening is formed at the bottom of the inner panel.

4. The underwear construction of claim 1 wherein the at least one inner opening is at the top and bottom of the inner panel.

5. The underwear construction of claim 1 further including an elastic waistband attached to the upper periphery of the underwear.

6. An underwear construction, comprising:

(a) trunk panel having an upper edge, a lower edge, and opposed side edges, each of the opposed side edges having concave portions formed therealong at least some portion of the opposed side edge and terminating at the lower edge;

(b) an inner panel having top and bottom edges and opposed side edges, the opposed side edges having upper portions, wherein the bottom edge is joined to the lower edge of the trunk panel and the opposed side edges are joined along their upper portions to the opposed side edges of the trunk panel, the top edge being unjoined; and (c) an outer panel having top and bottom edges and and opposed side edges, the opposed side edges having upper portions, said outer panel overlying the inner panel and joined to the lower edge of the trunk panel and to the upper portions of the opposed side edges of the trunk panel so that the underwear construction has an outside, an inside, and an upper periphery, and so that each of said opposed edges of said outer panel being unjoined along at least some portion, wherein a wearer of said underwear selectively has unencumbered access through either of the unjoined opposed side edges of the outer panel and the unjoined top edge of the inner panel.

7. The underwear construction of claim 6 further including an elastic waistband stitched around the periphery of the upper edges of said trunk panel and of said outer panel of the underwear.

8. An underwear construction comprising a pair of front panels, a rear panel, an inner panel having a top and a bottom, and an outer panel; wherein the front panel, rear panel, inner panel, and outer panel are attached in such a way that the underwear construction has an outside, an inside, and an upper periphery, and so that at least one opening is created on the inside between the inner panel and outer panel, and wherein the inner panel, outer panel, front panels, and rear panel are attached in such a way that there are two openings on the outside between the inner and outer panels, to provide a wearer of said underwear selective unencumbered access to the penis through either of the two outer openings and through the inner opening.

9. The underwear construction of claim 8 wherein the at least one inner opening is formed at the top of the inner panel.

10. The underwear construction of claim 8 wherein the at least one inner opening is formed at the bottom of the inner panel.

11. The underwear construction of claim 8 wherein the at least one inner opening are at the top and bottom of the inner panel.

12. The underwear construction of claim 8 further including an elastic waistband attached to the upper periphery of the underwear.

13. An underwear construction, comprising:

(a) a trunk panel having an upper edge, a lower edge and opposed side edges;

(d) first and second leg panels, each of said leg panels having a top edge and opposed side edges, wherein an opposed side edge of each of said first and second side panels is joined to one of the opposed side edges of said trunk panel;

(e) an inner panel having top and bottom edges and opposed side edges, wherein the bottom edge is joined to the lower edge of the trunk panel and the opposed side edges are joined to opposed side edges of each of said first and second leg panels, the top edge being unjoined; and (f) an outer panel having top and bottom edges and opposed side edges, said outer panel overlying the inner panel and joined to the lower edge of the trunk panel and to the upper portions of the opposed side edges of each of the first and second leg panels so that the underwear construction has an outside, an inside, and an upper periphery, each of said opposed edges of said outer panel being unjoined along at least some portion, wherein a wearer of said underwear selectively has unencumbered access through either of the unjoined opposed side edges of the outer panel and the unjoined top edge of the inner panel.

14. The underwear construction of claim 13 further including an elastic waistband stitched around the upper periphery of the upper edges of said rear panel, front panels, and of said outer panel of the underwear.

15. An underwear construction comprising fabric panels that are joined together to form underwear having a trunk portion and overlying inner and outer front portions so that the underwear construction has an outside and an inside, wherein the inner and outer front portions are attached in such a way that there are two openings on the outside between the inner and outer portions, to provide a wearer of said underwear selective unencumbered access to the penis through either of the two outer openings.

* * * * *

US006557183C1

(12) EX PARTE REEXAMINATION CERTIFICATE (5160th)

United States Patent
Truong et al.

(10) Number: US 6,557,183 C1
(45) Certificate Issued: Jul. 19, 2005

(54) MEN'S UNDERWEAR WITH DOUBLE FLY CONSTRUCTION

(75) Inventors: Tony N. Truong, Winston-Salem, NC (US); Teresa Thompson, Winston-Salem, NC (US)

(73) Assignee: Sara Lee Corporation, Winston-Salem, NC (US)

Reexamination Request:
No. 90/006,750, Aug. 15, 2003

Reexamination Certificate for:

| | |
|---|---|
| Patent No.: | **6,557,183** |
| Issued: | **May 6, 2003** |
| Appl. No.: | **10/008,038** |
| Filed: | **Nov. 5, 2001** |

(51) Int. Cl.[7] ..... A41B 9/02
(52) U.S. Cl. ..... 2/403; 2/405
(58) Field of Search ..... 2/405, 403, 404, 2/408, 400, 70–73, 78.1–78.3, 402, 227, 228, 238, 234; 604/385.1–396; D2/700, 712, 713

(56) References Cited

U.S. PATENT DOCUMENTS

| | | | | |
|---|---|---|---|---|
| 2,336,248 A | * | 12/1943 | Harwood | 2/403 |
| 3,706,103 A | * | 12/1972 | Senser | 2/403 |
| 3,844,282 A | * | 10/1974 | King | 2/405 |
| 4,414,971 A | * | 11/1983 | Chung | 2/405 |
| 5,029,345 A | * | 7/1991 | Angheluta et al. | 2/405 |

FOREIGN PATENT DOCUMENTS

| | | |
|---|---|---|
| DE | 3144501 | * 5/1983 |
| DE | 3340310 | 5/1985 |
| JP | 09228103 | 9/1997 |
| JP | 09302501 | 11/1997 |

* cited by examiner

*Primary Examiner*—A B Vanatta

(57) ABSTRACT

An underwear construction having a trunk panel, an inner panel with an open edge for providing access through the inner panel, an outer panel having openings along opposed side edges, the outer panel overlying the inner panel, wherein the trunk panel, inner panel, and outer panel are joined to provide a wearer of said underwear selective unencumbered access to the penis through either of the openings in said outer panel and through the open edge of said inner panel.

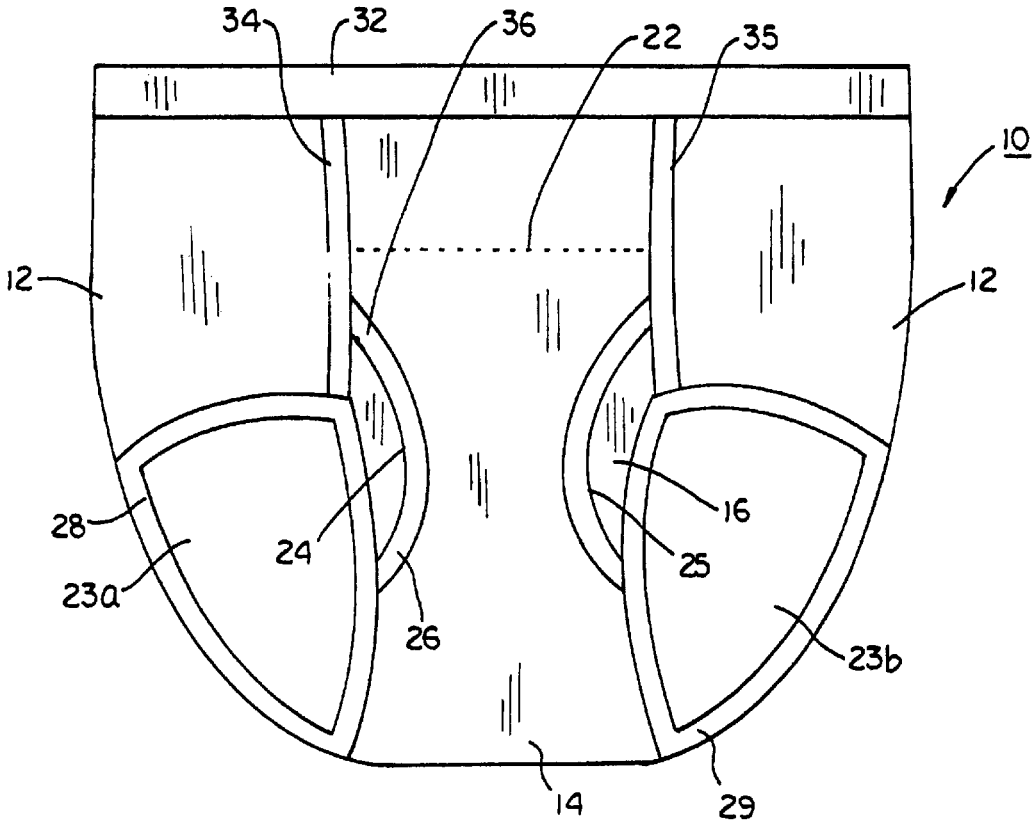

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–5, 8–12 and 15 are cancelled.

Claims 6 and 13 are determined to be patentable as amended.

Claims 7 and 14, dependent on an amended claim, are determined to be patentable.

6. An underwear construction, comprising:

(a) *a* trunk panel having an upper edge, a lower edge, and opposed side edges, each of the opposed side edges having concave portions formed therealong at least some portion of the opposed side edge and terminating at the lower edge;

(b) an inner panel having top and bottom edges and opposed side edges, the opposed side edges having upper portions, wherein the bottom edge is joined to the lower edge of the trunk panel and the opposed side edges are joined along their upper portions to the opposed side edges of the trunk panel, the top edge being unjoined; and (c) an outer panel having top and bottom edges and [and] opposed side edges, the opposed side edges having upper portions, said outer panel overlying the inner panel and joined to the lower edge of the trunk panel and to the upper portions of the opposed side edges of the trunk panel so that the underwear construction has an outside, an inside, and an upper periphery, and so that each of said opposed edges of said outer panel being unjoined along at least some portion, wherein a wearer of said underwear selectively has unencumbered access through either of the unjoined opposed side edges of the outer panel and the unjoined top edge of the inner panel.

13. An underwear construction, comprising:

(a) a trunk panel having an upper edge, a lower edge and opposed side edges;

([d]*b*) first and second leg panels, each of said leg panels having a top edge and opposed side edges, wherein an opposed side edge of each of said first and second side panels is joined to one of the opposed side edges of said trunk panel;

([e]*c*) an inner panel having top and bottom edges and opposed side edges, wherein the bottom edge is joined to the lower edge of the trunk panel and the opposed side edges are joined to opposed side edges of each of said first and second leg panels, the top edge being unjoined; and ([f]*d*) an outer panel having top and bottom edges and opposed side edges, said outer panel overlying the inner panel and joined to the lower edge of the trunk panel and to the upper portions of the opposed side edges of each of the first and second leg panels so that the underwear construction has an outside, an inside, and an upper periphery, each of said opposed edges of said outer panel being unjoined along at least some portion, wherein a wearer of said underwear selectively has unencumbered access through either of the unjoined opposed side edges of the outer panel and the unjoined top edge of the inner panel.

* * * * *